US006966849B2

(12) United States Patent
Kato

(10) Patent No.: US 6,966,849 B2
(45) Date of Patent: Nov. 22, 2005

(54) MULTI-PIECE SOLID GOLF BALL

(75) Inventor: Akira Kato, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 156 days.

(21) Appl. No.: 10/638,307

(22) Filed: Aug. 12, 2003

(65) Prior Publication Data

US 2004/0029648 A1 Feb. 12, 2004

(30) Foreign Application Priority Data

Aug. 12, 2000 (JP) ..... 2002-234799
Jun. 12, 2003 (JP) ..... 2003-167992

(51) Int. Cl.[7] ..... A63B 37/04
(52) U.S. Cl. ..... 473/376
(58) Field of Search ..... 473/376, 377, 473/370, 371, 367, 368

(56) References Cited

U.S. PATENT DOCUMENTS 5,743,816 A 4/1998 Ohsumi et al.
5,772,531 A 6/1998 Ohsumi et al.
5,816,937 A * 10/1998 Shimosaka et al. ..... 473/354
5,980,396 A * 11/1999 Moriyama et al. ..... 473/376
6,045,460 A * 4/2000 Hayashi et al. ..... 473/376
6,123,630 A * 9/2000 Hayashi et al. ..... 473/376
6,254,495 B1 7/2001 Nakamura et al.
6,271,296 B1 8/2001 Nakamura et al.
6,290,612 B1 * 9/2001 Maruko et al. ..... 473/376
6,468,169 B1 * 10/2002 Hayashi et al. ..... 473/371

FOREIGN PATENT DOCUMENTS

JP 9-266959 A 10/1997
JP 10-127818 A 5/1998
JP 10-127819 A 5/1998
JP 2000-245873 A 9/2000
JP 2001-17572 A 1/2001
JP 2001-17575 A 1/2001

* cited by examiner

*Primary Examiner*—Raenn Gorden
(74) *Attorney, Agent, or Firm*—Birch, Stewart, Kolasch & Birch, LLP

(57) ABSTRACT

The present invention provides a multi-piece solid golf ball, which is superior in flight distance, spin performance, shot feel and putting sound. The present invention relates to a multi-piece solid golf ball comprising a core consisting of a center, an intermediate layer formed on the center and an outer layer formed on the intermediate layer, and a cover covering the core, wherein the center has a diameter of 10 to 20 mm and a central point hardness in JIS-A hardness of 30 to 85, the intermediate layer has a surface hardness in Shore D hardness of 30 to 55, the outer layer has a hardness in Shore D hardness of 65 to 85 and comprises thermoplastic resin as a main component, and the cover has a Shore D hardness of 35 to 55 and a thickness of 0.3 to 1.5 mm.

14 Claims, 1 Drawing Sheet

MULTI-PIECE SOLID GOLF BALL

This nonprovisional application claims priority under 35 U.S.C. §119(a) on patent applicatiion No(s). 2000-234799 filed in Japan on Aug. 12, 2002 and 2003-167992 filed in Japan on Jun. 12, 2003, which is(are) herein incorporated by reference.

FIELD OF THE INVENTION

The present invention relates to a multi-piece solid golf ball. More particularly, it relates to a multi-piece solid golf ball, which is superior in flight distance, spin performance, shot feel and putting sound.

BACKGROUND OF THE INVENTION

In golf balls commercially selling, there are solid golf balls such as two-piece golf ball, three-piece golf ball and the like, and thread wound golf balls. Recently, the solid golf balls, of which flight distance can be improved while maintaining soft and good shot feel at the time of hitting as good as the conventional thread wound golf ball, generally occupy the greater part of the golf ball market. Multi-piece golf balls represented by three-piece golf ball have good shot feel while maintaining excellent flight performance because they can vary hardness distribution, when compared with the two-piece golf ball.

As representative examples of multi-piece solid golf balls, there is a three-piece solid golf ball comprising two-layer core or two-layer cover. As multi-piece solid golf balls that can further vary hardness distribution, there is a four-piece solid golf ball comprising two-layer core and two-layer cover, three-layer core or three-layer cover and the like have been proposed (Japanese Patent Kokai Publication Nos. 266959/1997, 127818/1998, 127819/1998, 245873/2000, 17572/2001, 17575/2001 and the like).

In Japanese Patent Kokai Publication Nos. 266959/1997, 127818/1998 and 127819/1998, a four-piece solid golf ball which comprises a cover and a three-layer core composed of an inner layer, an intermediate layer and an outer layer is described. In Japanese Patent Kokai Publication No. 266959/1997, the inner layer is designed to have a Shore D hardness lower than that of the intermediate layer, the intermediate layer has a Shore D hardness of 45 to 65 and the outer layer is designed to have a Shore D hardness lower than that of the intermediate layer; in Japanese Patent Kokai Publication No. 127818/1998, the intermediate layer has a JIS-C hardness of 50 to 80 and the outer layer is designed to have a hardness higher than that of the intermediate layer; and in Japanese Patent Kokai Publication No. 127819/1998, the inner layer JIS-C hardness of 40 to 90, the intermediate layer is formed from thermoplastic resin and has a JIS-C hardness of 50 to 80, and the outer layer has a JIS-C hardness of not less than 65.

In Japanese Patent Kokai Publication Nos. 17572/2001 and 17575/2001, a four-piece solid golf ball which comprises a cover and a three-layer core composed of a core, an enclosing layer and an intermediate layer is described. In Japanese Patent Kokai Publication No. 17572/2001, the core is essentially formed from thermoplastic resin or thermoplastic elastomer and has a diameter of 3 to 18 mm and a Shore D hardness of 50 to 95, the enclosing layer is essentially formed from thermoplastic resin or thermoplastic elastomer (and has a Shore D hardness lower than that of the core by not less than 10); in Japanese Patent Kokai Publication No. 17575/2001, the core is essentially formed from thermoplastic resin or thermoplastic elastomer and has a diameter of 3 to 18 mm and a Shore D hardness of 15 to 50, the enclosing layer is essentially formed from thermoplastic resin or thermoplastic elastomer, and the enclosing layer and intermediate layer have a substantially equal Shore D hardness at a boundary therebetween. In the five golf balls, since the three-layer core is not designed to have a hardness distribution such that the outer portion is hard and the inner portion is soft, it is impossible to efficiently deform the golf ball and the launch angle is low, which reduces the flight distance.

In Japanese Patent Kokai Publication No. 245873/2000, a four-piece solid golf ball comprising a core, an intermediate layer, an outer layer and a cover is described. The core has a surface hardness in JIS-C hardness of 67 to 85, the intermediate layer hardness in JIS-C hardness is higher than the surface hardness of the core, and the outer layer hardness in JIS-C hardness is higher than the intermediate layer hardness. In the golf ball, the three-layer core has a hardness distribution such that the outer portion is hard and the inner portion is soft. However, since the hardness difference between the surface of the outer layer and the surface of the core is small, high launch angle and low spin amount are not sufficiently accomplished, which reduces the flight distance. In addition, the outer layer hardness is low, and the golf ball has dull and deep sound when putting. Since the cover is formed from hard material, spin performance at approach shot is not sufficient obtained.

OBJECTS OF THE INVENTION

A main object of the present invention is to provide a multi-piece solid golf ball, which is superior in flight distance, spin performance, shot feel and putting sound.

According to the present invention, the object described above has been accomplished by providing a multi-piece solid golf ball comprising a core consisting of a center, an intermediate layer and an outer layer, and a cover; using thermoplastic resin for the outer layer; and adjusting a diameter and central point hardness of the center, a surface hardness of the intermediate layer and a hardness and thickness of the cover to specified ranges, thereby providing a multi-piece solid golf ball, which is superior in flight distance, spin performance, shot feel and putting sound.

This object as well as other objects and advantages of the present invention will become apparent to those skilled in the art from the following description with reference to the accompanying drawings.

SUMMARY OF THE INVENTION

The present invention provides a multi-piece solid golf ball comprising a core consisting of a center, an intermediate layer formed on the center and an outer layer formed on the intermediate layer, and a cover covering the core, wherein

- the center has a diameter of 10 to 20 mm and a central point hardness in JIS-A hardness of 30 to 85,
- the intermediate layer has a surface hardness in Shore D hardness of 30 to 55,
- the outer layer has a hardness in Shore D hardness of 65 to 85 and comprises thermoplastic resin as a main component, and
- the cover has a Shore D hardness of 35 to 55 and a thickness of 0.3 to 1.5 mm.

The present inventor has developed a multi-piece solid golf ball in different point of view from the conventional point, which the hardness at the distance of 5 to 10 mm from the central point of the center has great effect on the restraint of the spin amount when hit by a middle iron club to a driver. Thereby, in the multi-piece solid golf ball of the present invention, it is accomplished to restrain the spin amount when hit by a middle iron club to a driver to improve the flight distance by using three-layer structured core consisting of the center, intermediate layer and outer layer, decreasing the diameter and hardness of the center and having hardness distribution of the core such that the hardness is higher from the center to the surface of the core in order. In addition, the golf ball of the present invention has good sound when putting by using thermoplastic resin having high hardness for the outer layer, and has large spin amount when hit by a short iron and the like, which improves the controllability by using a soft material for the cover.

In order to put the present invention into a more suitable practical application, it is desired that the center and intermediate layer comprise a cis-1,4-polybutadiene rubber as a main component;

the cover comprise polyurethane-based thermoplastic elastomer as a main component; and the polyurethane-based thermoplastic elastomer be formed by using cycloaliphatic diisocyanate.

BRIEF EXPLANATION OF DRAWINGS

The present invention will become more fully understood from the detailed description given hereinbelow and the accomplishing drawings which are given by way of illustrating only, and thus are not limitative of the present invention, and wherein.

DETAILED DESCRIPTION OF THE INVENTION

Figure 1:
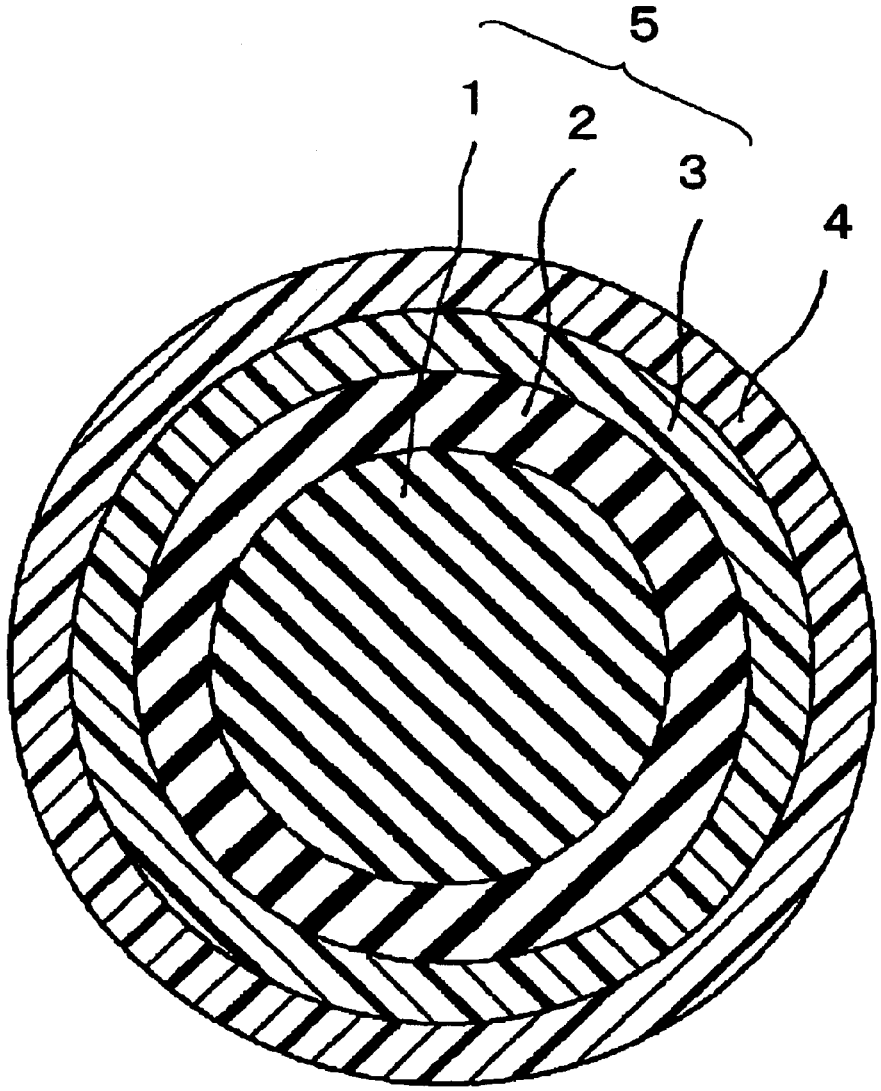
FIG. 1 is a schematic cross section illustrating one embodiment of the golf ball of the present invention.

The multi-piece solid golf ball of the present invention will be explained with reference to the accompanying drawing in detail. FIG. 1 is a schematic cross section illustrating one eittbodiment of the multi-piece solid golf ball of the present invention. As shown in FIG. 1, the golf ball of the present invention comprises a core 5 consisting of a center 1, an intermediate layer 2 formed on the center and an outer layer 3 formed on the intermediate layer, and a cover 4 covering the core.

In the golf ball of the present invention, the center 1 and intermediate layer 2 are not limited, but are preferably formed from a vulcanized molded article of rubber composition comprising cis-1,4-polybutadiene rubber as a main component. For example, the center and intermediate layer may be obtained by uniformly mixing a rubber composition using a proper mixer such as a mixing roll, and then vulcanizing and press-molding under applied heat the rubber composition in a mold into a spherical form. The rubber composition comprises 3 to 20 parts by weight in the center 1, or 20 to 35 parts by weight in the intermediate layer 2 of a vulcanizing agent (crosslinking agent), for example, α,β-unsaturated carboxylic acid having 3 to 8 carbon atoms (such as acrylic acid, methacrylic acid, etc.) or mono or divalent metal salts thereof, such as zinc or magnesium salts thereof, or a functional monomer such as trimethylolpropane trimethacrylate, or a combination thereof;

0.5 to 5 parts by weight, preferably 0.7 to 4 parts by weight of co-crosslinking initiator such as organic peroxides;

4 to 20 parts by weight, preferably 5 to 18 parts by weight of filler such as zinc oxide, barium sulfate; and optionally 0.5 to 5 parts by weight, preferably 0.7 to 4 parts by weight of organic sulfide compound, antioxidant and the like;

based on 100 parts by weight of a base rubber such as cis-1,4-polybutadiene rubber. However, the center 1 and intermediate layer 2 are given by way of illustrative examples only, and the invention shall not be limited thereto.

The center 1 used in the golf ball of the present invention can be obtained by uniformly mixing the rubber composition, and then vulcanizing and press-molding under applied heat the mixture in a mold. The vulcanization may be conducted, for example, by press molding in a mold at 130 to 180° C. and 2.9 to 9.8 MPa for 15 to 60 minutes.

In the golf ball of the present invention, it is required for the center 1 to have a diameter of 10 to 20 mm. When the diameter of the center 1 is smaller than 10 mm, the spin amount at the time of hitting is increased, and the hit golf ball creates blown-up trajectory, which reduces the flight distance. Therefore the lower limit of the diameter is preferably not less than 12 mm, more preferably not less than 14 mm. On the other hand, when the diameter is larger than 20 mm, the resulting golf ball is too soft, and the desired hardness is not obtained, which degrades the rebound characteristics. In addition, the shot feel is poor such that the rebound characteristics are poor. Therefore the upper limit of the diameter is preferably not more than 19 mm, more preferably not more than 16 mm, most preferably not more than 15 mm. The range of the diameter may be limited by the value of the upper limit in combination with any value of the lower limit.

In the golf ball of the present invention, it is required for the center 1 to have a central point hardness in JIS-A hardness of 30 to 85. When the central point hardness of the center 1 is lower than 30, the rebound characteristics of the center are degraded, and the rebound characteristics of the resulting golf ball are degraded, which reduces the flight distance. Therefore the lower limit of the central point hardness is preferably not less than 35, more preferably not less than 40. On the other hand, when the central point hardness is higher than 85, the technical effects of restraining the spin amount at the time of hitting are not sufficiently obtained. In addition, the shot feel is hard and poor. Therefore the upper limit of the central point hardness is preferably not more than 81, more preferably not more than 80, further preferably not more than 75, particularly preferably not more than 72, most preferably not more than 70. The range of the diameter may be limited by the value of the upper limit in combination with any value of the lower limit. The term "a central point hardness of the center 1" as used herein refers to the hardness, which is obtained by cutting the center into two equal parts and then measuring a hardness at the central point in section.

In the golf ball of the present invention, it is desired for the center 1 to have a surface hardness in JIS-A hardness of 30 to 89. When the surface hardness of the center 1 is lower than 30, the rebound characteristics of the center is too low, and the rebound characteristics of the resulting golf ball are degraded, which reduces the flight distance. Therefore the lower limit of the surface hardness is preferably not less than 35, more preferably not less than 40. On the other hand, when the surface hardness of the center 1 is higher than 89, the center is too hard, and the shot feel of the resulting golf ball is poor. In addition, the technical effects of restraining the spin amount at the time of hitting are not sufficiently obtained. Therefore the upper limit of the surface hardness is preferably not more than 80, more preferably not more than 76, most preferably not more than 70. The range of the diameter may be limited by the value of the upper limit in combination with any value of the lower limit. The term "a surface hardness of the center 1" as used herein refers to the hardness, which is determined by measuring a hardness at the surface of the resulting center.

The intermediate layer 2 is then formed on the center 1. A method of covering the center 1 with the intermediate layer 2 is not specifically limited, but may be conventional methods, which have been known to the art and used for forming the two-layer structured core of the golf balls. For example, there can be used a method comprising uniformly mixing the composition for the intermediate layer, coating on the center 1 into a concentric sphere, followed by pressure molding in a mold at 130 to 180° C. for 10 to 40 minutes; or a method comprising molding the composition for the intermediate layer into a semi-spherical half-shell in advance, covering the center 1 with the two half-shells, followed by pressure molding at 130 to 180° C. for 10 to 40 minutes.

In the golf ball of the present invention, it is desired for the intermediate layer 2 to have a thickness of 5.0 to 15.0 mm, preferably 6.0 to 14.0 mm, more preferably 7.0 to 13.0 mm. When the thickness of the intermediate layer 2 is smaller than 5.0 mm, the shot feel of the resulting golf ball is hard and poor, because the outer layer is formed from hard material. On the other hand, when the thickness is larger than 15.0 mm, the rebound characteristics of the resulting golf ball are degraded, which reduces the flight distance.

In the golf ball of the present invention, it is required for the intermediate layer 2 to have a surface hardness in Shore D hardness of 30 to 55, preferably 32 to 53, more preferably 35 to 50. When the surface hardness of the intermediate layer 2 is lower than 30, the core is too soft, and it is difficult to adjust the hardness of the resulting golf ball to a proper range. On the other hand, when the hardness is higher than 55, the intermediate layer is too hard, and the shot feel is poor. In addition, the spin amount at the time of hitting is increased, which reduces the flight distance. The term "a hardness of the intermediate layer 2" as used herein, means the surface hardness of the spherical molded article having a two-layered structure, which is formed by integrally press-molding the center and the intermediate layer.

The outer layer 3 is then formed on the intermediate layer 2 to form the core 5 having three-layered structure. In the golf ball of the present invention, it is desired for the outer layer 3 to have a thickness of 0.5 to 5.0 mm, preferably 0.7 to 4.5 mm, more preferably 1.0 to 4.0 mm. When the thickness of the outer layer 3 is smaller than 0.5 mm, the core is too soft, and it is difficult to adjust the hardness of the resulting golf ball to a proper range, because the intermediate layer is formed from soft material. On the other hand, when the thickness is larger than 5.0 mm, the shot feel of the resulting golf ball is hard and poor.

In the golf ball of the present invention, it is required for the outer layer 3 to have a hardness in Shore D hardness of 65 to 85, preferably 67 to 80, more preferably 70 to 78. When the hardness of the outer layer 3 is lower than 65, it is difficult to restrain the spin amount at the time of hitting of the resulting golf ball, which reduces the flight distance. In addition, good putting sound of the resulting golf ball is not obtained. On the other hand, when the hardness is higher than 85, the outer layer is too hard, and the shot feel is hard and poor. The term "a hardness of the outer layer 3" as used herein refers to the hardness (slab hardness) measured using a sample of a stack of the three or more heat and press molded sheets having a thickness of about 2 mm from the outer layer composition, which had been stored at 23° C. for 2 weeks.

In the golf ball of the present invention, a material used for the outer layer 3 is not limited as long as it has properties as described above, but it is desired for the outer layer 3 to comprise hard material having excellent rebound characteristics, particularly thermoplastic resin other than ionomer resin as a main component. Examples of the materials used for the outer layer 3 include thermoplastic elastomer, such as polyester-based thermoplastic elastomer, polyamide-based thermoplastic elastomer, polyurethane-based thermoplastic elastomer and the like; polyamide resin, polyacetal resin, polycarbonate resin, acrylic resin, polyolefin resin and modified compounds thereof.

Examples of the commercially available materials for the outer layer 3 include polyester-based thermoplastic elastomer, which is commercially available from Toray-Du Pont Co., Ltd. under the trade name of "Hytrel" (such as "Hytrel 7247"); polyamide-based thermoplastic elastomer, which is commercially available from Atofina Japan Co., Ltd. under the trade name of "Pebax" (such as "Pebax 7233"); polyurethane-based elastomer, which is commercially available from BASF Polyurethane Elastomers Co., Ltd. under the trade name of "Elastollan" (such as "Elastollan XHM76D"); and the like.

A method of covering the intermediate layer 2 with the outer layer 3 is not specifically limited, but may be conventional methods, which have been known to the art and used for forming the cover of the golf balls. For example, there can be used a method comprising molding the outer layer composition into a semi-spherical half-shell in advance, covering the spherical molded article formed by integrally press-molding the center and the intermediate layer with the two half-shells, followed by press molding at 130 to 170° C. for 1 to 5 minutes, or a method comprising injection molding the outer layer composition directly on the spherical molded article, which is covered with the outer layer, to cover it.

In the golf ball of the present invention, the core 5 has a diameter of 39.5 to 42.5 mm, preferably 40.0 to 42.3 mm, more preferably 40.5 to 42.0 mm. When the diameter of the core is smaller than 39.5 mm, it is required to increase the thickness of the cover in order to adjust the diameter of the resulting golf ball to diameter conformed to the regulations for golf balls, and the rebound characteristics of the golf ball are degraded, which reduces the flight distance. On the other hand, when the diameter of the core is larger than 42.5 mm, the diameter of the golf ball after molding the cover is too large, and air resistance on the fly is large, which reduces the flight distance.

The cover 4 is then covered on the core 5. In the golf ball of the present invention, it is required for the cover 4 to have a thickness of 0.3 to 1.5 mm, preferably 0.5 to 1.2 mm, more preferably 0.7 to 1.0 mm. When the thickness is smaller than 0.3 mm, the technical effects of softening the cover are not sufficiently obtained, and the spin amount at short iron shot to approach shot is small, which degraded the controllability. On the other hand, when the thickness is larger than 1.5 mm, the spin amount at the time of hitting is large, and the hit golf ball creates blown-up trajectory, which reduces the flight distance.

In the golf ball of the present invention, it is required for the cover 4 to have a hardness in Shore D of 35 to 55, preferably 37 to 53, more preferably 40 to 50. When the hardness of the cover 4 is lower than 55, the cover is too soft, and the spin amount when hit by a driver to middle iron club is increased. Therefore, the hit golf ball creates blown-up trajectory, which reduces the flight distance. On the other hand, when the cover hardness is higher than 55, the cover is too hard, and the impact force at the time of hitting is large, which degrades the shot feel. In addition, the spin amount at approach shot is small, and the controllability is poor. The term "a hardness of the cover 4" as used herein refers to the hardness (slab hardness) measured using a sample of a stack of the three or more heat and press molded sheets having a thickness of about 2 mm from the cover composition, which had been stored at 23° C. for 2 weeks.

As the materials used in the cover of the present invention, preferred is polyurethane-based thermoplastic elastomer in view of scuff resistance, and particularly preferred is polyurethane-based thermoplastic elastomer formed by using cycloaliphatic diisocyanate in view of rebound characteristics, scuff resistance and yellowing resistance. Examples of the cycloaliphatic diisocyanates include one or combination of two or more selected from the group consisting of 4,4-dicyclohexylmethane diisocyanate ($H_{12}$MDI), which is hydrogenated compound of 4,4-diphenylmethane diisocyanate (MDI); 1,3-bis (isocyanatomethyl) cyclohexane ($H_6$XDI), which is hydrogenated compound of xylylene diisocyanate (XDI); isophorone diisocyanate (IPDI); and trans-1,4-cyclohexane diisocyanate (CHDI). Preferred is the $H_{12}$MDI in view of general-purpose properties and processability. Concrete examples of the polyurethane based thermoplastic elastomer formed by using the $H_{12}$MDI include polyurethane-based thermoplastic elastomers, which are commercially available from BASF Japan Co., Ltd. under the trade name of "Elastollan XNY585", "Elastollan XNY90A", "Elastollan XNY97A", and the like.

As the materials suitably used in the cover 4 of the present invention, the above polyurethane-based thermoplastic elastomer may be used alone, but the polyurethane-based thermoplastic elastomer may be used in combination with at least one of the other thermoplastic elastomer, diene-based block copolymer, ionomer resin and the like. Examples of the other thermoplastic elastomers include the other polyurethane-based thermoplastic elastomer, polyamide-based thermoplastic elastomer, polyester-based thermoplastic elastomer, styrene-based thermoplastic elastomer, polyolefin-based thermoplastic elastomer and the like. The other thermoplastic elastomer may have functional group, such as carboxyl group, glycidyl group, sulfone group, epoxy group and the like.

Concrete examples of the other thermoplastic elastomers include polyurethane-based elastomer, which is commercially available from BASF Japan Co., Ltd. under the trade name of "Elastollan" (such as "Elastollan ET880"); polyamide-based thermoplastic elastomer, which is commercially available from Atofina Japan Co., Ltd. under the trade name of "Pebax" (such as "Pebax 2533"); polyester-based thermoplastic elastomer, which is commercially available from Toray-Du Pont Co., Ltd. under the trade name of "Hytrel" (such as "Hytrel 3548", "Hytrel 4047"); styrene-based thermoplastic elastomer available from Asahi Chemical Industry Co., Ltd. under the trade name "Tuftec" (such as "Tuftec H1051"); olefin-based thermoplastic elastomer available from Mitsubishi Chemical Co., Ltd. under the trade name "Thermoran" (such as "Thermoran 3981"); polyolefin-based thermoplastic elastomer, which is commercially available from Sumitomo Chemical Co., Ltd. under the trade name of "Sumitomo TPE" (such as "Sumitomo TPE3682" and "Sumitomo TPE9455"); and the like.

The diene-based block copolymer is a block copolymer or partially hydrogenated block copolymer having double bond derived from conjugated diene compound. The base block copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene-based block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene-based block copolymers which are commercially available include the diene-based block copolymers, which are commercially available from Daicel Chemical Industries, Ltd. under the trade name of "Epofriend" (such as "Epofriend A1010"), the diene-based block copolymers, which are commercially available from Kuraray Co., Ltd. under the trade name of "Septon" (such as "Septon HG-252") and the like.

The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, lithium ions, magnesium ions and the like, in view of rebound characteristics, durability and the like.

The ionomer resin is not limited, but examples thereof will be shown by a trade name thereof. Examples of the ionomer resins, which are commercially available from Du Pont-Mitsui Polychemicals Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856and the like. Examples of the ionomer resins, which are commercially available from Du Pont Co., include Surlyn 8945, Surlyn 9945, Surlyn 6320 and the like. Examples of the ionomer resins, which are commercially available from Exxon Chemical Co., include Iotek 7010, Iotek 8000 and the like. These ionomer resins may be used alone or in combination.

The amount of the other thermoplastic elastomer, diene-based block copolymer or ionomer resin is 0 to 40 parts by weight, preferably 0 to 30 parts by weight, based on 100 parts by weight of the base resin for the cover. When the amount is larger than 40 parts by weight, either scuff resistance, rebound characteristics or yellowing resistance are degraded.

The composition for the cover 4 used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component as long as the addition of the additives does not deteriorate the desired performance of the golf ball cover. If used, the amount of the pigment is preferably 0.1 to 5.0 parts by weight, based on 100 parts by weight of the base resin for the cover.

A method of covering on the core 5 with the cover 4 is not specifically limited, but may be a conventional method. For example, there can be used a method comprising molding the cover composition into a semi-spherical half-shell in advance, covering the core with the two half-shells, followed by press molding at 130 to 170° C. for 1 to 5 minutes, or a method comprising injection molding the cover composition directly on the core, which is covered with the cover, to cover it. At the time of molding the cover, many depressions called "dimples" are formed on the surface of the golf ball. Furthermore, paint finishing or marking with a stamp may be optionally provided after the cover is molded for commercial purposes. The golf ball of the present invention is formed, so that it has a diameter of not less than 42.67 mm (preferably 42.67 to 42.82 mm) and a weight of not more than 45.93 g, in accordance with the regulations for golf balls.

EXAMLES

The following Examples and Comparative Examples further illustrate the present invention in detail but are not to be construed to limit the scope of the present invention.

Production of core (i) Production of center

The rubber composition for the center having the formulation shown in Tables 1 and 2 was mixed, and then vulcanized by press-molding at 160° C. for 20 minutes in the mold to obtain spherical center. The weight, diameter, central point hardness and surface hardness of the resulting center were measured, and the results are shown in Tables 4 and 5.

(ii) Formation of intermediate layer

The rubber composition for the intermediate layer having the formulation shown in Tables 1 and 2 was mixed, and coated on the center produced in the step (i) into a concentric sphere, and then vulcanized by press-molding at 165° C. for 20 minutes in the mold to form intermediate layer on the center and obtain two-layer structured core. The thickness and surface hardness of the resulting intermediate layer were measured, and the results are shown in Tables 4 and 5.

TABLE 1

| Composition | (parts by weight) A | B | C | D | E |
|---|---|---|---|---|---|
| | (Center composition) | | | | |
| BR-11 *1 | 100 | 100 | 100 | 100 | 100 |
| Zinc acrylate | 6 | 9 | 15 | 3 | 25 |
| Zinc oxide | 5 | 5 | 5 | 5 | 5 |
| Barium sulfate | 9.5 | 27 | 18.5 | 15.5 | 5.5 |
| Dicumyl peroxide | 1 | 1 | 1 | 1 | 1 |
| Diphenyl disulfide | 0.5 | 0.5 | 0.5 | 0.5 | 0.5 |

TABLE 1-continued

| Composition | (parts by weight) A | B | C | D | E |
|---|---|---|---|---|---|
| | (Intermediate layer composition) | | | | |
| BR-11 *1 | 100 | 100 | 100 | 100 | 100 |
| Zinc acrylate | 18 | 22 | 30 | 22 | 22 |
| Zinc oxide | 5 | 5 | 5 | 5 | 5 |
| Barium sulfate | 3.5 | 22 | 12 | 6.5 | 6.5 |
| Dicumyl peroxide | 0.5 | 0.5 | 0.5 | 0.5 | 0.5 |

TABLE 2

| Composition | (parts by weight) F | G | H | I | J | K |
|---|---|---|---|---|---|---|
| | (Center composition) | | | | | |
| BR-11 *1 | 100 | 100 | 100 | 100 | 100 | 100 |
| Zinc acrylate | 6 | 15 | 9 | 9 | 9 | 8 |
| Zinc oxide | 5 | 5 | 5 | 5 | 5 | 5 |
| Barium sulfate | 9.5 | 5 | 12.5 | 12.5 | 30.5 | 27.5 |
| Dicumyl peroxide | 1 | 1 | 1 | 1 | 1 | 1 |
| Diphenyl disulfide | 0.5 | 0.5 | 0.5 | 0.5 | 0.5 | 0.5 |
| | (Intermediate layer composition) | | | | | |
| BR-11 *1 | 100 | 100 | 100 | 100 | 100 | 100 |
| Zinc acrylate | 18 | 18 | 10 | 36 | 22 | 30 |
| Zinc oxide | 5 | 5 | 5 | 5 | 5 | 5 |
| Barium sulfate | 3.5 | 3.5 | 12 | 0.5 | 25.5 | 12 |
| Dicumyl peroxide | 0.5 | 0.5 | 0.5 | 0.5 | 0.5 | 0.5 |

*1: High-cis Polybutadiene rubber, commercially available from JSR Co., Ltd. under the trade name of "BR-11" (Content of 1,4-cis-polybutadiene: 96%)

(iii) Preparation off compositions for outer layer and cover

The formulation materials for the outer layer and cover showed in Table 3 were mixed using a kneading type twin-screw extruder to obtain pelletized outer layer and cover compositions. The extrusion condition was, a screw diameter of 45 mm, a screw speed of 200 rpm, and a screw L/D of 35.

The formulation materials were heated at 160 to 260° C. at the die position of the extruder. The Shore D hardness was measured, using a sample of a stack of the three or more heat and press molded sheets having a thickness of about 2 mm from the outer layer and cover composition, which had been stored at 23° C. for 2 weeks. The results are shown in Tables 3 to 5 as outer layer hardness and cover hardness.

TABLE 3

| Outer layer and cover composition | (parts by weight) a | b | c | d | e | f | g |
|---|---|---|---|---|---|---|---|
| Hytrel 7247 *2 | 100 | — | — | — | — | — | — |
| Pebax 7233 *3 | — | 100 | — | — | — | — | — |
| Elastollan XHM76D *4 | — | — | 100 | — | — | — | — |
| Surlyn 8945 *5 | — | — | — | 50 | — | — | — |
| Surlyn 9945 *6 | — | — | — | 50 | — | — | — |
| Elastollan XNY585 *7 | — | — | — | — | 100 | — | — |
| Elastollan XNY90A *8 | — | — | — | — | — | 100 | — |
| Elastollan XNY97A *9 | — | — | — | — | — | — | 100 |

TABLE 3-continued

| Outer layer and cover composition | (parts by weight) a | b | c | d | e | f | g |
|---|---|---|---|---|---|---|---|
| Titanium dioxide | — | — | — | — | 4 | 4 | 4 |
| Hardness (Shore D) | 72 | 72 | 76 | 64 | 37 | 42 | 47 |

*2: Hytrel 7247 (trade name), polyester-based thermoplastic elastomer, which is commercially available from Toray-Du Pont Co., Ltd.
*3: Pebax 7233 (trade name), polyamide-based thermoplastic elastomer, which is commercially available from Atofina Japa Co., Ltd.
*4: Elastollan XHM76D (trade name), polyurethane-based thermoplastic elastomer formed by using diisocyanate, commercially available from BASF Polyurethane Elastomers Co., Ltd.
*5: Surlyn 8945 (trade name), ethylene-methacrylic acid copolymer ionomer resin obtained by neutralizing with sodium ion, manufactured by Du Pont Co.
*6: Surlyn 9945 (trade name), ethylene-methacrylic acid copolymer ionomer resin obtained by neutralizing with zinc ion, manufactured by Du Pont Co.
*7: Elastollan XNY585 (trade name), polyurethane-based thermoplastic elastomer formed by using 4,4'-dicyclohexylmethane diisocyanate ($H_{12}MDI$), commercially available from BASF polyurethane Elastomers Co., Ltd. Shore A (JIS-A) hardness = 85
*8: Elastollan XNY90A (trade name), polyurethane-based thermoplastic elastomer formed by using 4,4'-dicyclohexylmethane diisocyanate ($H_{12}MDI$), commercially available from BASF polyurethane Elastomers Co., Ltd. Shore A (JIS-A) hardness = 90
*9: Elastollan XNY97A (trade name), polyurethane-based thermoplastic elastomer formed by using 4,4'-dicyclohexylmethane diisocyanate ($H_{12}MDI$), commercially available from BASF polyurethane Elastomers Co., Ltd. Shore A (JIS-A) hardness = 97

(iv) Production of three-layer structured core

The outer layer composition prepared in the step (iii) was injection-molded to obtain semi-spherical half-shells for the outer layer. The two-layer structured core produced in the step (ii) was covered with the two semi-spherical half-shells for the outer layer, and then press-molded in the mold at 150° C. for 2 minutes to obtain three-layer structured core having a diameter of 41.2 mm and a weight of 41.1 g. The thickness of the resulting outer layer was measured, and the result is shown in Tables 4 and 5.

(Examples 1 to 3 and Comparative Examples 1 to 7)

The cover composition prepared in the step (iii) was injection-molded to obtain semi-spherical half-shells for the cover. The three-layer structured core produced in the step (iv) was covered with the two semi-spherical half-shells for the cover, and then press-molded in the mold at 150° C. for 2 minutes to form a cover layer having a thickness of 0.8 mm. Then, clear paint was applied on the surface to obtain golf ball having a diameter of 42.8 mm and weight of 45.3 g. The flight performance (initial velocity, spin amount and flight distance), shot feel and putting sound of the resulting golf balls were measured or evaluated. The results are shown in Tables 6 and 7. The test methods are as follows.

(Test method)

(1) Hardness (i) Hardness of the center

A JIS-A hardness was measured at the central point and surface of the center. The surface hardness of the center was determined by measuring a hardness at the surface of the resulting center. The central point hardness of the center was determined by cutting the resulting center into two equal parts and then measuring a hardness at its central point in section. The JIS-A hardness was measured by using an automatic rubber hardness tester (type LA1), which is commercially available from Kobunshi Keiki Co., Ltd., with a JIS-A hardness meter according to JIS K 6253.

(ii) Hardness of the intermediate layer

The surface hardness of the intermediate layer was determined by measuring a Shore D hardness at the surface of the resulting two-layer structured spherical molded article obtained by forming the intermediate layer on the center. The Shore D hardness was measured by using an automatic rubber hardness tester (type LA1), which is commercially available from Kobunshi Keiki Co., Ltd., with a Shore D hardness meter according to ASTM D 2240.

(iii) Hardness of the outer layer and cover

The hardness of the outer layer and cover was determined by measuring a Shore D hardness, using a sample of a stack of the three or more heat and press molded sheets having a thickness of about 2 mm from the outer layer and cover composition, which had been stored at 23° C. for 2 weeks. The Shore D hardness was measured by using an automatic rubber hardness tester (type LA1), which is commercially available from Kobunshi Keiki Co., Ltd., with a Shore D hardness meter according to ASTM D 2240.

(2) Flight performance (i) Flight performance (1)

After a No. 1 wood club (a driver, W#1; "XXIO" loft angle=8 degrees, X shaft, manufactured by Sumitomo Rubber Industries, Ltd.) having metal head was mounted to a swing robot manufactured by Golf Laboratory Co. and a golf ball was hit at head speed of 50 m/sec, the initial velocity, spin amount (backspin amount) immediately after hitting and flight distance were measured. As the flight distance, total that is a distance to the stop point of the hit golf ball was measured. The measurement was conducted 12 times (n=12) for each golf ball, and the average is shown as the result of the golf ball.

(ii) Flight performance (2)

After a sand wedge (SW; "DP-601", manufactured by Sumitomo Rubber Industries, Ltd.) was mounted to a swing robot manufactured by Golf Laboratory Co. and each golf ball was hit at head speed of 21 m/sec, the spin amount (backspin amount) immediately after hitting was measured. The measurement was conducted 12 times for each golf ball (n=12), and the average is shown as the result of the golf ball.

(4) Shot feel (i) Shot feel (1)

The shot feel of the golf ball is evaluated by the evaluation criteria obtained from the average of the score evaluated by 10 golfers according to a practical hitting test using a No. 1 wood club (W#1, a driver) having metal head, which primarily evaluated for impact force at the time of hitting. The score and evaluation criteria are as follows. The results are shown in the Tables together with the average value described in parentheses ( ).

(Score)

5: The golf ball has good shot feel such that the impact force at the time of hitting is small.

4: The impact force at the tame of hitting is slightly small.

3: The impact force at the time of hitting is fairly small.

2: The impact force at the time of hitting is slightly large.

1: The golf ball has poor shot feel such that the impact force at the time of hitting is large.

(Evaluation criteria)

o: Average score of 3.4 to 5.0

Δ: Average score of 2.7 to 3.3 x: Average score of 1.0 to 2.6

(ii) Shot feel (2)

The shot feel of the golf ball is evaluated by the evaluation criteria obtained from the average of the score evaluated by 10 golfers according to a practical hitting test using a No. 1 wood club (W#1, a driver) having metal head, which primarily evaluated for rebound characteristics at the time of hitting. The score and evaluation criteria are as follows. The results are shown in the Tables together with the average value described in parentheses ( ).

(Score)

5: The golf ball has good shot feel such that the rebound characteristics at the time of hitting are large.

4: The rebound characteristics at the time of hitting are slightly large.

3: The rebound characteristics at the time of hitting are fairly large.

2: The rebound characteristics at the time of hitting are slightly small.

1: The golf ball has poor shot feel such that the rebound characteristics at the time of hitting are small.

(Evaluation criteria)

o: Average score of 3.4 to 5.0

Δ: Average score of 2.7 to 3.3 x: Average score of 1.0 to 2.6

(4) Putting sound

The putting sound of the golf ball is evaluated by 10 golfers according to a practical hitting test using a putter. The evaluation criteria are as follows. The results shown in the Tables below are based on the fact that the most golfers evaluated with the same criterion about putting sound.

(Evaluation criteria)

o: The golf ball has good putting sound such that the sound is moderate.

Δ: The golf ball has fairly good putting sound.

x: The golf ball has poor putting sound such that the sound is dull and deep.

TABLE 4

| | Example No. | | | | Comparative Example No. | |
|---|---|---|---|---|---|---|
| Test time | 1 | 2 | 3 | 4 | 1 | a |
| Center/Outer layer composition | A | B | C | K | D | E |
| (Center) | | | | | | |
| Diameter (mm) | 12.0 | 15.0 | 19.0 | 15.0 | 15.0 | 15.0 |
| Weight (g) | 0.9 | 2.1 | 4.0 | 2.1 | 1.9 | 1.9 |
| Central point hardness (JIS-A) | 46 | 72 | 81 | 66 | 25 | 90 |
| Surface hardness (JIS-A) | 50 | 76 | 86 | 70 | 27 | 96 |
| (Intermediate layer) | | | | | | |
| Thickness (mm) | 11.6 | 11.1 | 10.1 | 11.1 | 11.1 | 11.1 |
| Surface hardness (Shore D) | 39 | 46 | 50 | 50 | 45 | 45 |
| (Outer layer) | | | | | | |
| Composition | a | b | c | c | a | a |
| Thickness (mm) | 3.0 | 2.0 | 1.0 | 2.0 | 2.0 | 2.0 |
| Hardness (Shore D) | 72 | 72 | 76 | 76 | 72 | 72 |
| (Cover) | | | | | | |
| Composition | e | f | g | g | f | f |
| Hardness (Shore D) | 37 | 42 | 47 | 47 | 42 | 42 |

TABLE 5

| | Comparative Example No. | | | | |
|---|---|---|---|---|---|
| Test item | 3 | 4 | 5 | 6 | 7 |
| Center/Outer layer composition | F | G | H | I | J |
| (Center) | | | | | |
| Diameter (mm) | 8.0 | 22.0 | 15.0 | 15.0 | 15.0 |
| Weight (g) | 0.3 | 5.8 | 1.9 | 1.9 | 2.1 |
| Central point hardness (JIS-A) | 47 | 80 | 71 | 71 | 72 |
| Surface hardness (JIS-A) | 49 | 86 | 75 | 75 | 76 |
| (Intermediate layer) | | | | | |
| Thickness (mm) | 13.6 | 6.6 | 11.1 | 11.1 | 11.1 |
| Surface hardness (Shore D) | 39 | 39 | 24 | 59 | 46 |
| (Outer layer) | | | | | |
| Composition | a | a | a | a | d |
| Thickness (mm) | 3.0 | 3.0 | 2.0 | 2.0 | 2.0 |
| Hardness (Shore D) | 72 | 72 | 72 | 72 | 64 |
| (Cover) | | | | | |
| Composition | f | f | f | f | f |
| Hardness (Shore D) | 42 | 42 | 42 | 42 | 42 |

TABLE 6

| | Example No. | | | | Comparative Example No. | |
|---|---|---|---|---|---|---|
| Test item | 1 | 2 | 3 | 4 | 1 | 2 |
| Flight performance (1) (W#1; 50 m/sec) | | | | | | |
| Initial velocity (m/sec) | 71.8 | 72.0 | 72.1 | 72.2 | 70.9 | 72.1 |
| Spin amount (rpm) | 2420 | 2380 | 2450 | 2300 | 2250 | 2760 |
| Total (m) | 265.0 | 266.5 | 265.5 | 267.5 | 253.0 | 258.0 |

TABLE 6-continued

| Test item | Example No. 1 | 2 | 3 | 4 | Comparative Example No. 1 | 2 |
|---|---|---|---|---|---|---|
| Flight performance (2) (SW; 21 m/sec) | | | | | | |
| Spin amount (rpm) | 6850 | 6750 | 6710 | 6710 | 6720 | 6800 |
| Shot feel (1) | Δ | Δ | Δ | Δ | ○ | x |
| Impact | (3.3) | (3.3) | (2.8) | (3.0) | (4.7) | (2.0) |
| Shot feel (2) | ○ | ○ | ○ | ○ | x | ○ |
| Rebound | (3.5) | (4.6) | (4.9) | (5.0 | (2.1) | (4.9) |
| Putting sound | ○ | ○ | ○ | ○ | ○ | ○ |

TABLE 7

| Test item | Comparative Example No. 3 | 4 | 5 | 6 | 7 |
|---|---|---|---|---|---|
| Flight performance (1) (W#1; 50 m/sec) | | | | | |
| Initial velocity (m/sec) | 71.8 | 71.1 | 70.6 | 72.4 | 71.4 |
| Spin amount (rpm) | 2720 | 2230 | 2200 | 2880 | 2450 |
| Total (m) | 257.5 | 254.5 | 252.0 | 259.0 | 262.0 |
| Flight performance (2) (SW; 21 m/sec) | | | | | |
| Spin amount (rpm) | 6760 | 6780 | 6700 | 6870 | 6710 |
| Shot feel (1) | x | ○ | ○ | x | ○ |
| Impact | (2.6) | (4.0) | (4.8) | (2.3) | (3.8) |
| Shot feel (2) | ○ | x | x | ○ | x |
| Rebound | (3.6) | (1.9) | (1.3) | (5.0) | (2.3) |
| Putting sound | ○ | Δ | Δ | ○ | x |

As is apparent from Tables 6 to 7, the golf balls of the present invention of Examples 1 to 4 are superior in flight distance, spin performance, shot feel and putting sound, compared with the conventional golf balls of Comparative Examples 1 to 7.

On the other hand, in the golf ball of Comparative Example 1, since the hardness of the center is low, the initial velocity when hit by a driver is small, which reduces the flight distance. In addition, the shot feel is heavy and poor such that the rebound characteristics are poor. In the golf ball of Comparative Example 2, since the hardness of the center is high, the spin amount when hit by a driver is large, which reduces the flight distance. In addition, the shot feel is poor such that the impact force at the time of hitting is large.

In the golf ball of Comparative Example 3, since the diameter of the center is too small, the spin amount when hit by a driver is large, which reduces the flight distance. In addition, the shot feel is poor such that the impact force at the time of hitting is large. In the golf ball of Comparative Example 4, since the diameter of the center is too large, the initial velocity when hit by a driver is small, which reduces the flight distance. In addition, the shot feel is poor such that the rebound characteristics are poor.

In the golf ball of Comparative Example 5, since the hardness of the intermediate layer is too low, the initial velocity when hit by a driver is small, which reduces the flight distance. In addition, the shot feel is heavy and poor such that the rebound characteristics are poor. In the golf ball of the Comparative Example 6, since the hardness of the intermediate layer is too high, the spin amount when hit by a driver is large, which reduces the flight distance. In addition, the shot feel is poor such that the impact force at the time of hitting is large. In the golf ball of Comparative Example 7, since the hardness of the outer layer is too low, the initial velocity when hit by a driver is small, which reduces the flight distance. In addition, the shot feel and putting sound are poor.

What is claimed is:

1. A multi-piece solid golf ball comprising a core consisting of a center, an intermediate layer formed on the center and an outer layer formed on the intermediate layer, and a cover covering the core, wherein the center has a diameter of 10 to 19 mm and a central point hardness in JIS-A hardness of 30 to 80, the intermediate layer has a surface hardness in Shore D hardness of 30 to 55, the outer layer has a hardness in Shore D hardness of 65 to 85 and comprises thermoplastic resin as a main component, and the cover has a Shore D hardness of 35 to 55 and a thickness of 0.3 to 1.5 mm.

2. The multi-piece solid golf ball according to claim 1, wherein the center and intermediate layer comprise a cis-1, 4-polybutadiene rubber as a main component.

3. The multi-piece solid golf ball according to claim 1, wherein the cover comprises polyurethane-based thermoplastic elastomer as a main component.

4. The multi-piece solid golf ball according to claim 1, wherein the polyurethane-based thermoplastic elastomer is formed by using cycloaliphatic diisocyanate.

5. The multi-piece solid golf ball according to claim 1, wherein the center has a diameter of 12 to 16 mm.

6. The multi-piece solid golf ball according to claim 1, wherein the center has a diameter of 14 to 15 mm.

7. The multi-piece solid golf ball according to claim 1, wherein the center has a central point hardness in JIS-A hardness of 35 to 75.

8. The multi-piece solid golf ball according to claim 1, wherein the center has a central point hardness in JIS-A hardness of 40 to 70.

9. The multi-piece solid golf ball according to claim 1, wherein the intermediate layer has a surface hardness in Shore D hardness of 32 to 53.

10. The multi-piece solid golf ball according to claim 1, wherein the intermediate layer has a surface hardness in Shore D hardness of 35 to 50.

11. The multi-piece solid golf ball according to claim 1, wherein the outer layer has a hardness in Shore D hardness of 67 to 80.

12. The multi-piece solid golf ball according to claim 1, wherein the outer layer has a hardness in Shore D hardness of 70 to 78.

13. The multi-piece solid golf ball according to claim 1, wherein the cover has a Shore D hardness of 37 to 53.

14. The multi-piece solid golf ball according to claim 1, wherein the cover has a Shore D hardness of 40 to 50.

* * * * *